US008820129B2

(12) United States Patent
Dolev

(10) Patent No.: US 8,820,129 B2
(45) Date of Patent: Sep. 2, 2014

(54) CYLINDER LOCK ASSEMBLY WITH NON-ROTATING ELEMENTS

(76) Inventor: Moshe Dolev, Raanana (IL)

( * ) Notice: Subject to any disclaimer, the term of this patent is extended or adjusted under 35 U.S.C. 154(b) by 0 days.

(21) Appl. No.: 13/439,995

(22) Filed: Apr. 5, 2012

(65) Prior Publication Data

US 2013/0091910 A1 Apr. 18, 2013

Related U.S. Application Data

(63) Continuation-in-part of application No. 13/271,246, filed on Oct. 12, 2011.

(51) Int. Cl.

| | |
|---|---|
| ***E05B 19/06*** | (2006.01) |
| ***E05B 35/00*** | (2006.01) |
| *E05B 19/00* | (2006.01) |
| *E05B 17/00* | (2006.01) |
| *E05B 27/00* | (2006.01) |

(52) U.S. Cl.

CPC ..... *E05B 27/0017* (2013.01); *E05B 19/0058* (2013.01); *E05B 35/005* (2013.01); *E05B 17/0004* (2013.01); *E05B 27/0053* (2013.01); *E05B 2027/0025* (2013.01); *E05B 35/003* (2013.01); *E05B 27/0042* (2013.01)

USPC ..... 70/409; 70/492; 70/493

(58) Field of Classification Search

CPC ..... E05B 27/0082; E05B 27/0078; E05B 19/0017; E05B 19/0023; E05B 19/0029; E05B 19/0035; E05B 19/0041; E05B 19/0052; E05B 19/0058; E05B 19/0064; E05B 19/0094

USPC ..... 70/DIG. 60, 492–495, 409, 376–378, 70/392, 395–399, DIG. 23, 387, 411, 412, 70/393, 402, 405–407, 410, 453, 454; 292/170, 174

See application file for complete search history.

(56) References Cited

U.S. PATENT DOCUMENTS

| | | | | | |
|---|---|---|---|---|---|
| 2,057,532 | A | * | 10/1936 | MacDonald | 200/42.02 |
| 2,301,155 | A | * | 11/1942 | Sebestyen et al. | 70/134 |
| 3,243,979 | A | * | 4/1966 | Silvern | 70/411 |
| 3,499,302 | A | * | 3/1970 | Flora et al. | 70/494 |
| 4,098,104 | A | * | 7/1978 | Wolter | 70/406 |
| 4,116,025 | A | * | 9/1978 | Wolter | 70/358 |
| 4,213,316 | A | * | 7/1980 | Tietz | 70/358 |
| 4,229,957 | A | * | 10/1980 | Schneerson et al. | 70/134 |
| 4,232,539 | A | * | 11/1980 | Lo | 70/492 |
| 4,325,242 | A | * | 4/1982 | Tietz | 70/401 |
| 4,823,575 | A | | 4/1989 | Florian | |

(Continued)

FOREIGN PATENT DOCUMENTS

| | | |
|---|---|---|
| DE | 29503395 | 4/1995 |
| DE | 4430807 | 3/1996 |

(Continued)

OTHER PUBLICATIONS

PCT Written Opinion, PCT/US2012/059691, Jul. 31, 2013.

*Primary Examiner* — Lloyd Gall

(74) *Attorney, Agent, or Firm* — Dekel Patent Ltd.; David Klein

(57) ABSTRACT

A key device including a shaft including a key-cut surface for forming inward key cuts thereon, a key head mounted on the shaft; and a fixed key pin protruding outwards from the key-cut surface.

8 Claims, 14 Drawing Sheets

(56) References Cited

U.S. PATENT DOCUMENTS

| | | | | | |
|---|---|---|---|---|---|
| 4,869,085 | A * | 9/1989 | Meissner | 70/409 |
| 5,187,957 | A * | 2/1993 | Yang | 70/493 |
| 5,493,884 | A * | 2/1996 | Hinz et al. | 70/407 |
| 5,797,287 | A * | 8/1998 | Prunbauer | 70/409 |
| 5,970,761 | A * | 10/1999 | Eden, Jr. | 70/390 |
| 6,023,954 | A * | 2/2000 | Field | 70/409 |
| 6,119,496 | A * | 9/2000 | Theriault | 70/406 |
| 6,257,033 | B1 * | 7/2001 | Ziv-Av | 70/494 |
| 7,377,146 | B2 * | 5/2008 | Field et al. | 70/495 |
| 7,392,676 | B2 * | 7/2008 | Eden, Jr. | 70/493 |
| 8,302,439 | B1 * | 11/2012 | Tobias et al. | 70/394 |
| 2004/0172992 | A1 * | 9/2004 | Huang | 70/358 |
| 2011/0072867 | A1 * | 3/2011 | Haviv et al. | 70/357 |

FOREIGN PATENT DOCUMENTS

| | | |
|---|---|---|
| DE | 202009011052 | 2/2011 |
| EP | 1593800 | 11/2005 |
| EP | 2022912 | 2/2009 |
| WO | 2004/009937 | 1/2004 |

* cited by examiner

CYLINDER LOCK ASSEMBLY WITH NON-ROTATING ELEMENTS

CROSS-REFERENCE TO RELATED APPLICATIONS

This application is a continuation-in-part of U.S. patent application Ser. No. 13/271,246, filed Oct. 12, 2011, the contents of which are hereby incorporated by reference in their entirety.

FIELD OF THE INVENTION

The present invention relates generally to cylinder locks, and particularly to a cylinder lock assembly with non-rotating plug locking elements.

BACKGROUND OF THE INVENTION

As is well known in the prior art, many cylinder locks include a plug (also called a tumbler) arranged for rotation in a body. The plug and body are provided with a number of bores in which plug pins and driver pins are disposed. The plug is formed with a keyway for inserting therein a key. The driver pins are aligned with the plug pins, and the plug and driver pins have varying lengths that define a key cut combination. Upon insertion of a key with the correct key cut combination, the faces of the plug pins and driver pins that touch each other are aligned flush with the circumferential surface of the plug, referred to as the shear line, and the plug may be rotated to actuate the lock. If the key cut combination is not correct, at least one of the driver and plug pins will cross over the shear line and prevent rotation of the plug, and thus prevent actuation of the lock.

The number of possible key cut combinations for such prior art cylinder locks depends only on the number of pins, the relative lengths of the plug and driver pins, and on the depths of the key cuts.

SUMMARY OF THE INVENTION

The present invention seeks to provide cylinder lock assemblies with improved quality and security, as is described in detail further hereinbelow. The present invention significantly increases the number of possible key cut combinations. The present invention also provides convenient master keying possibilities. A key device (that is, key blank or key with key cuts formed thereon) is also provided in accordance with an embodiment of the present invention.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

It is noted that the terms "upper", "lower", "above", "below", "left" and "right", and the like, only refer to the sense of the drawings and do not limit the invention in any way.

It is further noted that ends of the plug are defined as follows: the "key insertion" end or the "proximal" end of the plug is the end facing the user for inserting the key into the keyway; the "distal" end is opposite to the key insertion end. The proximal and distal ends of the key correspond to the proximal and distal ends of the plug when the key is fully inserted into the plug.

Figures 1, 1A:
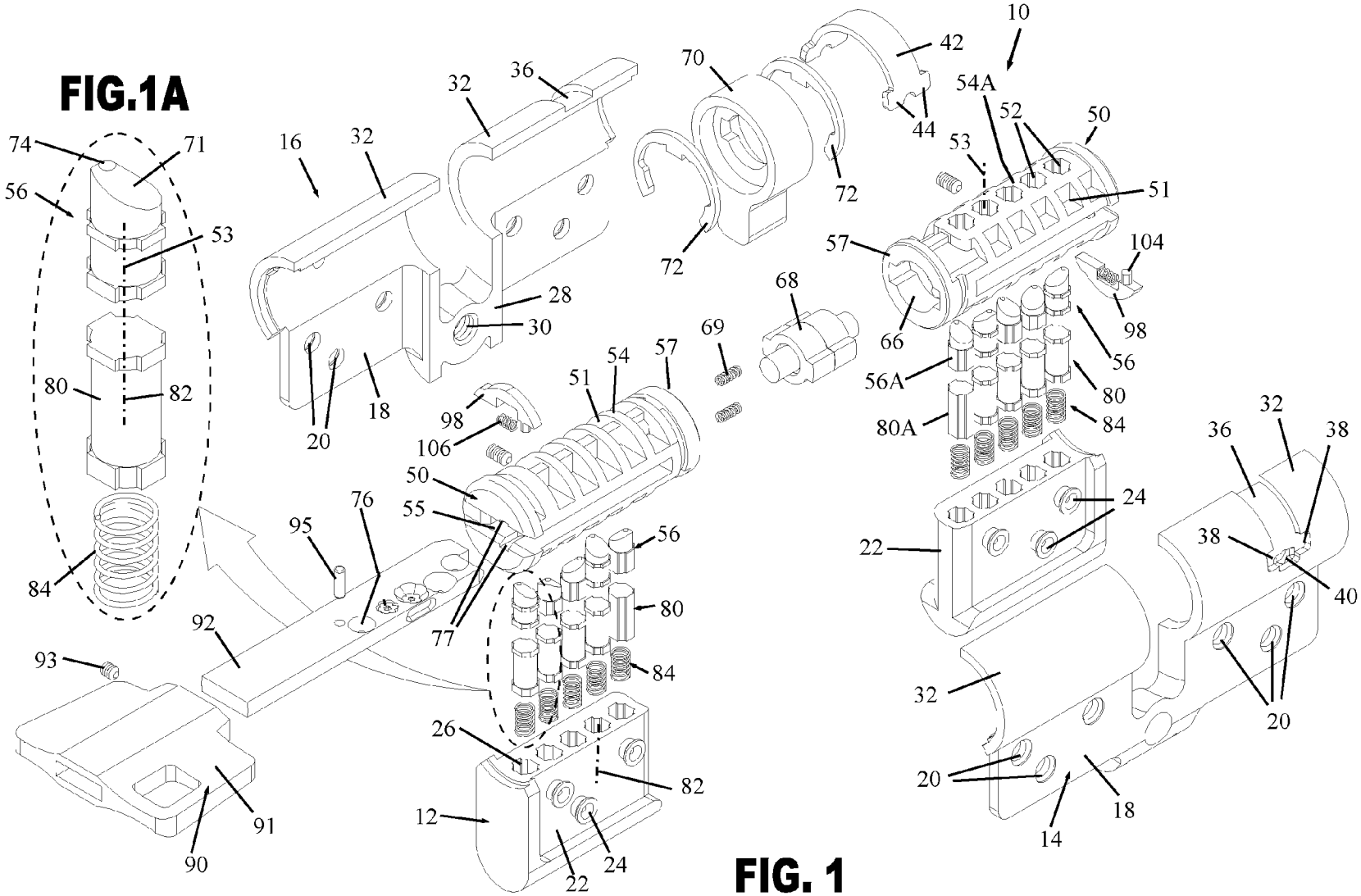
FIG. 1 is a simplified exploded illustration of a cylinder lock, constructed and operative in accordance with an embodiment of the present invention, employing non-rotating plug locking elements disposed in a plug (the driver pins in the cylinder lock body may also be non-rotating)
FIG. 1A is a simplified enlarged illustration of one of the plug locking elements and one of the driver pins of the cylinder lock body of FIG. 1, with a biasing device (e.g., coil spring)

Reference is now made to FIG. 1, which illustrates a cylinder lock assembly 10 (also referred to as cylinder lock 10), constructed and operative in accordance with a non-limiting embodiment of the present invention. The illustrated embodiment is for a European profile double cylinder lock, but it is understood that the invention is not limited to such a cylinder lock.

Cylinder Lock Body 12

In the illustrated embodiment, cylinder lock assembly 10 includes a body 12 made of two half-shells 14 and 16 (which are the same for both sides of the double cylinder lock) and one or more chassis 22. The invention is not limited to just two shells and any number is also possible. Accordingly the general term "shell" is also used to refer to half-shell, third-shell, etc.

The shells 14 and 16 each include a lower side wall 18 formed with mounting holes 20 (e.g., through holes). The shells 14 and 16 are assembled to a pair of chassis 22, one chassis 22 for each end of the double cylinder lock. Chassis 22 has built-in rivets 24 on both sides thereof for fastening to mounting holes 20. The buck-tails of rivets 24 (the part that is placed through holes 20) are bucked, upset, swaged or otherwise deformed after placement in holes 20 to form the rivet connection.

Chassis 22 is formed with bores 26 for receiving therein driver pins described further below. As will be explained below, bores 26 do not have a circular cross-section. Rivets 24 are positioned between bores 26 so that the rivets get support from the chassis walls and do not collapse the bores.

The lower side wall 18 has two portions for each end of the double cylinder lock. These portions are connected by a member 28 that has a tapped hole 30 for accepting a mounting screw (not shown), typically used to mount a cylinder lock in a mortise lock of a door (not shown).

Figures 4A, 4B:
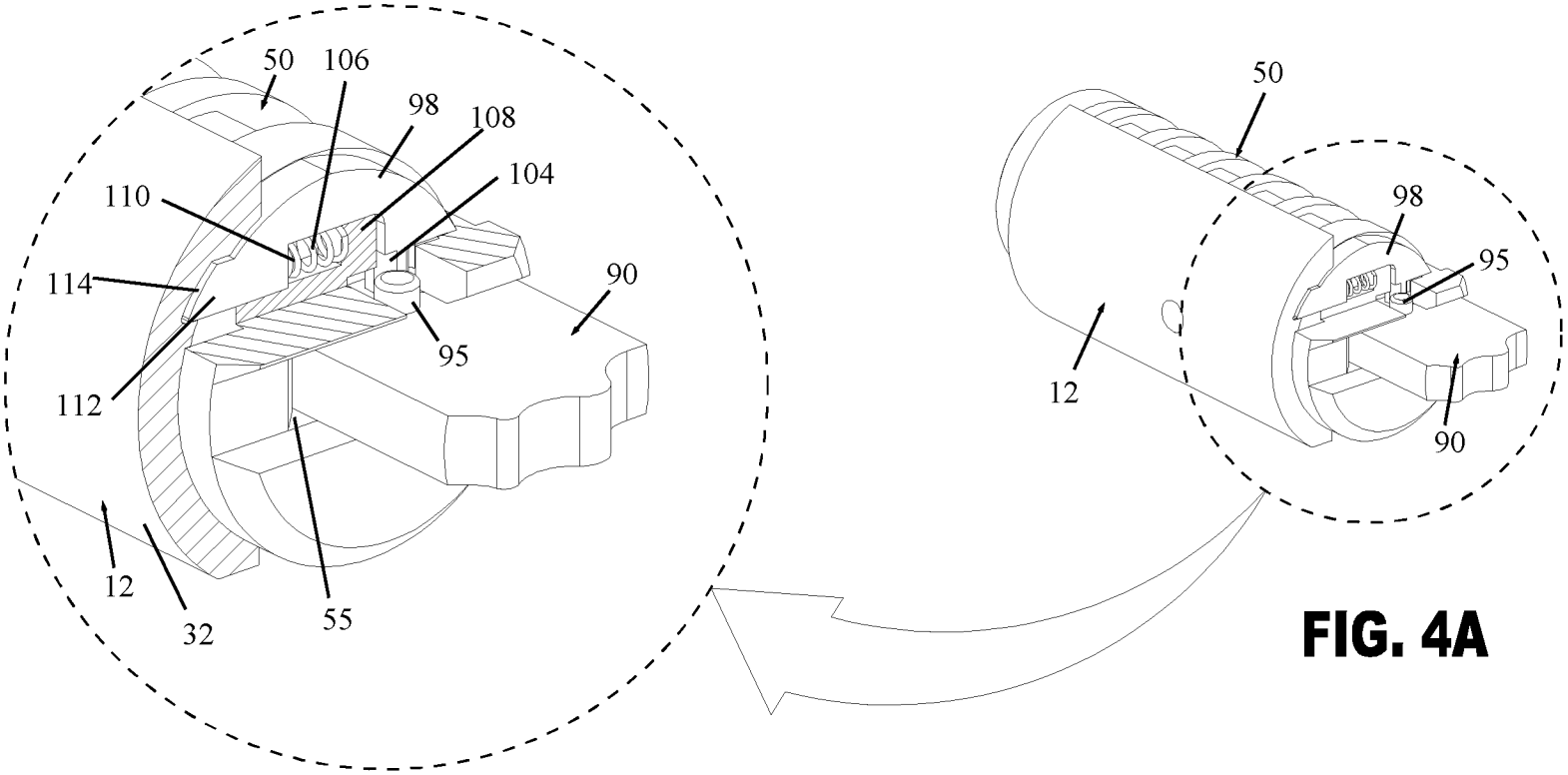
FIGS. 4A and 4B are simplified perspective and enlarged, partially sectional illustrations, respectively, of a key pin cooperating with a lock element in the cylinder lock of FIG. 1.
Figure 4C:
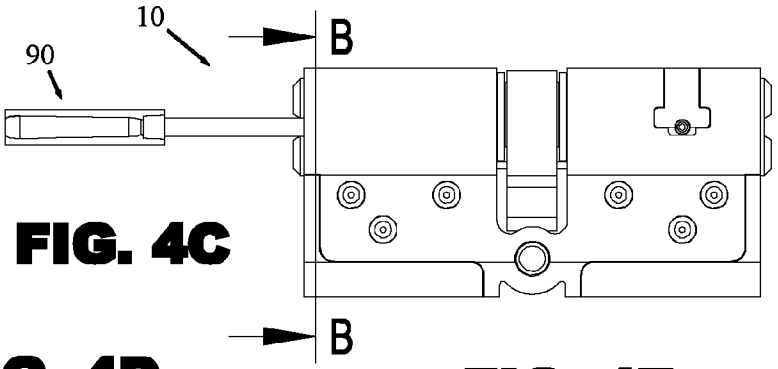
FIG. 4C is a simplified side view illustration and FIGS. 4D, 4E and 4F are sectional illustrations, taken along lines B-B in FIG. 4C, of the key pin cooperating with the lock element in the cylinder lock of FIG. 1.
Figure 4E:
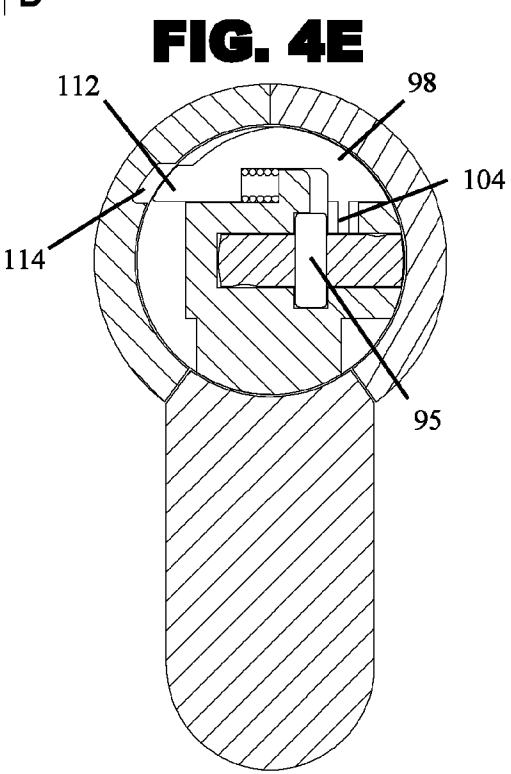
Figure 4D:
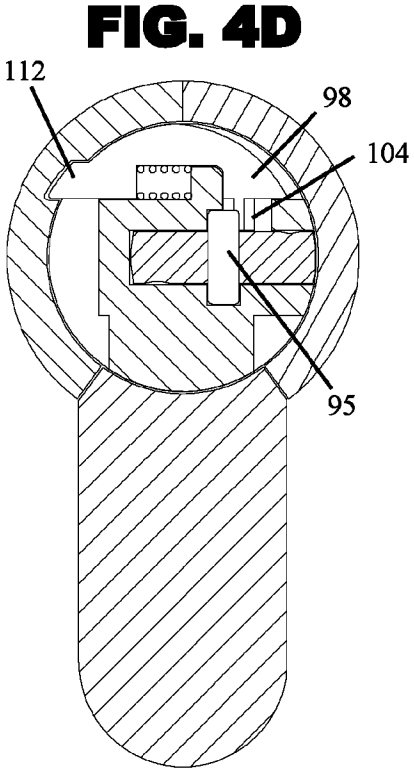

Shells 14 and 16 each include an upper half-cylindrical wall 32 extending from lower side wall 18. One half-cylindrical wall 32 is (or both are) formed with a partially circumferential groove 36 which ends in two axial notches 38. A small recess 40 may be formed at the end of groove 36 between notches 38. Optionally or additionally to rivets 24, a resilient clasp 42 (FIG. 1 and also appears in FIG. 4C), formed with two outwardly extending tabs 44 at ends thereof, fits into groove 36 in the final assembly for securing the two shells 14 and 16 to one another. Tabs 44 fit into notches 38. A small tool (e.g., small flat blade screwdriver, not shown) can be inserted in recess 40 to dislodge clasp 42 from groove 36 for disassembly, if needed (in the option of no rivets). In the final assembly, the pair of half-cylindrical walls 32 form the upper part of the standard European profile cylinder lock.

It is noted that rivets 24 and clasp 42 are just one example of fasteners for fastening the shells 14 and 16 together, and other fasteners can be used, such as but not limited to, circlips, retaining rings, snap rings, screws and many others. It is noted that clasps 42 are optional and the lock halves may be fastened sufficiently without them. It is further noted that clasps 42 may be attached to the bottom of the assembly (not shown) with no need for riveting the rivets 24.

It is noted that the cylinder lock body 12 can be constructed of two shells without a chassis, by appropriately reshaping the two shells, for example. It is also noted that the parts for the inner end and outer end of the cylinder lock are preferably identical to reduce manufacturing and inventory costs.

Figures 8, 8A, 8B:
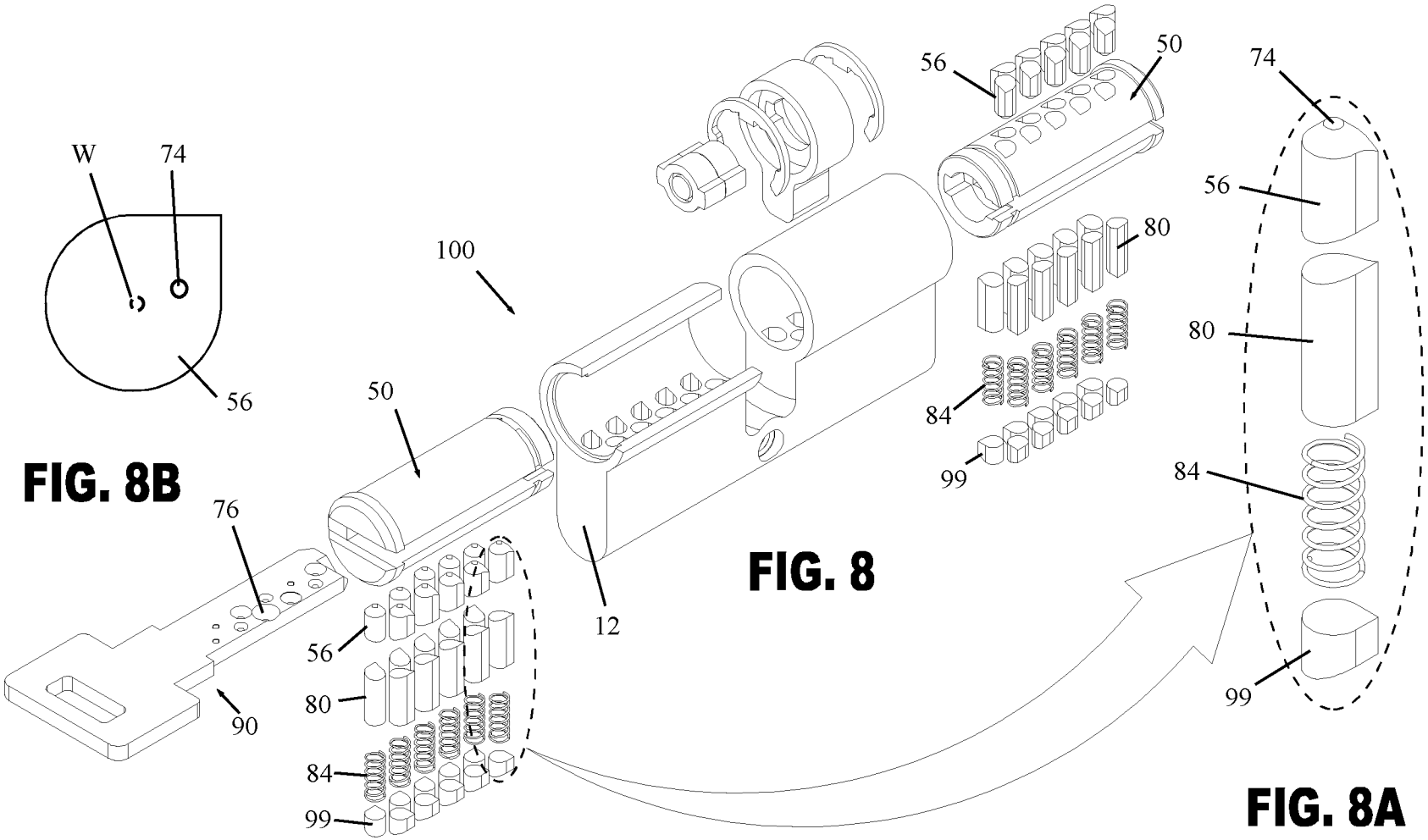
FIG. 8 is a simplified exploded illustration of a cylinder lock, constructed and operative in accordance with another embodiment of the present invention, employing non-rotating plug locking elements disposed in a plug.
FIG. 8A is a simplified enlarged illustration of one of the plug locking elements and one of the driver pins of the cylinder lock body of FIG. 8, with a biasing device (e.g., coil spring)
FIG. 8B is a simplified enlarged illustration of the droplet shape of the plug locking element of FIG. 8.

It is further noted that the cylinder lock body 12 can be made of a one-piece construction, such as shown in the embodiment of FIG. 8.

Plug 50

Cylinder lock assembly 10 includes a plug 50 which includes a plurality of chambers 52, separated by walls 54A, for receiving therein plug locking elements 56, described further below. Chambers 52 may be of equal size or may have different sizes. In the illustrated embodiment, there are five chambers 52, but the invention is not limited to this number. Each chamber 52 has a chamber depth axis 53. Each chamber 52 has a non-circular cross-section. The side opposite the chamber 52 may be formed with cutouts or apertures 51 between walls 54, so that there is uniform wall thickness, which is advantageous for MIM.

Plug 50 has a key insertion end 55, also called keyway 55, and a distal end 57, which is the end opposite to the key insertion end 55. Distal end 57 is formed with a recess 66 for receiving therein a spring-loaded coupling 68, which may be spring-loaded by means of springs 69. Coupling 68 interfaces with and rotates a standard cam 70, or other kinds of cams, as is well known in the art. Retaining clips 72 may be assembled on either side of cam 70.

Manufacture of Cylinder Lock Body and Plug

Metal injection molding (MIM) is a manufacturing technique for making complex, accurate and strong parts, which are difficult, expensive or impossible to be made by machining, casting or sintering. MIM merges injection molding and powdered metal technologies by blending a polymer with an extremely fine metal powder. The blended material is then melted and injection molded to produce intricately formed parts that are repeatable in high production manufacturing.

In the MIM method, a metal-filled or a metallic powder-filled plastic is injected into a mold. Upon removal from the mold, the part still has in it plastic binders and the part is called a "green part". The part is then cured, cooled and the plastic binding matrix is removed from between the metal particles. The part is then sintered, and due to the fine powders used, the density of the molded component dramatically increases. Afterwards, MIM components can have mechanical, wear, and corrosion resistance properties equivalent to machined material.

The cylinder lock body 12 and plug 50 may be preferably made by MIM, e.g., using a stainless steel alloy, such as but not limited to, 17-4 PH, a precipitation hardening martensitic stainless steel. Most of these parts should have low weight (e.g., not more than 50 g) and substantially uniform wall thickness (including the walls 54 of plug 50). The capital investment in molds for the MIM process can be significantly less (10% of the cost) than the investment in transfer machines commonly used in making brass cylinder locks. With the MIM process, one can manufacture a cylinder lock out of hardened metal, such as stainless steel, as opposed to the weaker brass. However, even though MIM is preferred for improving strength and resistance to tampering (violent and non-violent), it is recognized that all of the parts may be made by other methods, such as machining.

Plug Locking Element 56

Reference is made additionally to FIG. 1A, for an enlarged view of the pin locking element 56. The plug locking element includes a key cut interface probe 74 for interfacing with a key cut 76 formed on a key 90 (shown in FIG. 3). The key cut interface probe 74 is formed at an end 71 of the plug locking element 56, and is offset from the centerline 53 (i.e., central longitudinal axis) of plug locking element 56. (Probe 74 may be flush with end 71, or recessed, or protrude from end 71.) For example, end 71 may be tapered, and key cut interface probe 74 is formed at the apex of the tapered end 71. The end 67 opposite to end 71 is shaped to match the outer contour of plug 50. (One or more key cut interface probes 74 may be at the central longitudinal axis of the plug locking element 56.)

Plug locking elements 56 are received in chambers 52, and arranged to move along the chamber depth axis 53. Plug locking element 56 and chamber 52 each have a non-circular cross-section with respect to chamber depth axis 53. As seen in FIG. 1A, and in four of the elements in FIG. 1, the non-circular cross-section of the pin locking element 56 extends partially along the chamber depth axis 53 (e.g., the non-circular cross-section may be made of two girths separated by a gap from each other, which makes picking difficult). Alternatively, the non-circular cross-section may extend completely along the chamber depth axis 53, as seen in the element marked 56A in FIG. 1. The cross-section may include at least one straight portion. Alternatively, the cross-section includes at least one straight portion and at least one curved portion. The embodiment of FIGS. 8-8B utilizes a cross-section which is droplet-shaped, as is explained further below.

Because of the non-circular shapes of plug locking elements 56 and chambers 52, the plug locking elements 56 cannot rotate about chamber depth axis 53. Each plug locking elements 56 is assembled at a particular predetermined rotational orientation with respect to chamber depth axis 53. The rotational orientations are different due to the key cut interface probes 74 being offset from the centerline of plug locking element 56. Thus, each key cut interface probe 74 has a predetermined rotational orientation with respect to chamber depth axis 53. The key cut interface probes 74 may be located not only at the same radial distance from the centerline but rotated to different orientations; rather, the key cut interface probes 74 may be located at different radial distances from the centerline and/or at different X-Y locations.

Figure 2B:
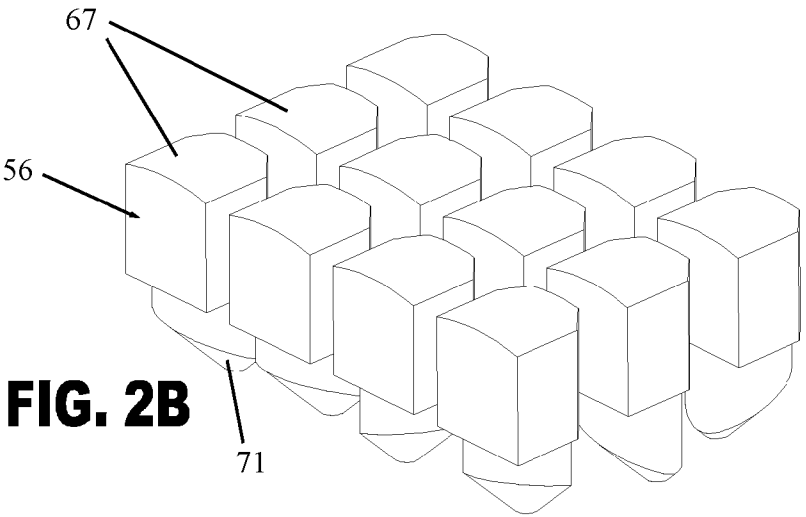
FIGS. 2A, 2B and 2C are simplified upper-view and lower-view perspective illustrations and top-view illustration, respectively, of different possible orientations of key cut interface probes formed on the plug locking elements of FIG. 1, in accordance with an embodiment of the present invention.
Figure 2A:
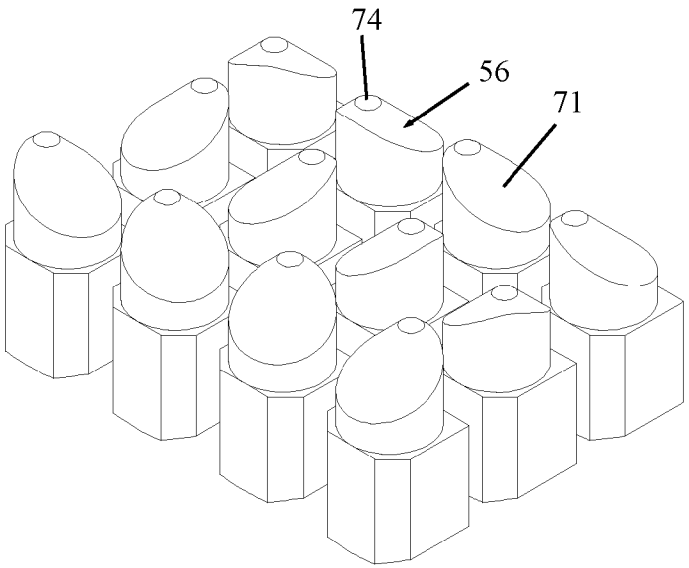
Figure 2C:
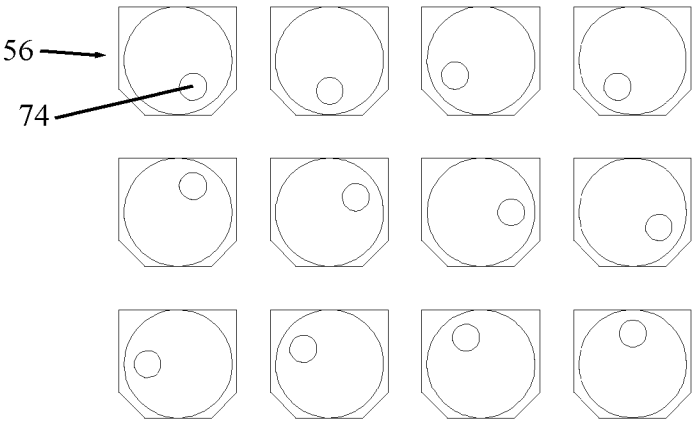

For example, as seen in FIGS. 2A, 2B and 2C, there are twelve (12) different possible orientations of key cut interface probes 74 formed on the plug locking elements 56 of FIG. 1. If, for example, there are five (5) different lengths used for the plug locking elements 56 and five (5) chambers 52, there are $(12\times5)^5=60^5$ (777,600,000) different key combinations. This is in contrast with a simple cylinder lock with five (5) different lengths used for the plug pins and five (5) chambers, which has merely $5^5$ (3125) different key combinations. As will be explained later with reference to FIGS. 5A-6, the present invention allows for increasing the number of depths for possible key cuts. Thus, in the present invention, there are, for example, six (6) different lengths used for the plug locking elements 56 and five (5) chambers 52, making a total of $(12\times6)^5=72^5$ (1,934,917,632) different key combinations. The improvement of the present invention over the prior art is enormous: over 1.9 billion as opposed to about 3 thousand! Even a simple cylinder lock with eight (8) different lengths used for the plug pins and five (5) chambers has merely $8^5$ (32768) different key combinations.

Driver Pin 80

Plug locking elements 56 are aligned with driver pins 80. Each driver pin 80 is disposed in bore 26 (of chassis 22). Bore 26 has a bore depth axis 82. Driver pin 80 is arranged to move along bore depth axis 82 and not rotate about bore depth axis 82. This is due to the non-circular cross-section of bore 26. (Alternatively, bore 26 and driver pin 80 may have a circular cross-section.) Driver pins 80 are biased by a biasing device 84, such as a coil spring.

As seen in FIG. 1A, and in four of the elements in FIG. 1, the non-circular cross-section of the driver pin 80 extends partially along the bore depth axis 82 (e.g., the non-circular cross-section may be made of two girths separated by a gap from each other, an anti-picking feature). Alternatively, the non-circular cross-section may extend completely along the bore depth axis 82, as seen in the driver pin marked 80A in FIG. 1.

Key Device (Key Blank/Key) 90

Figure 3:
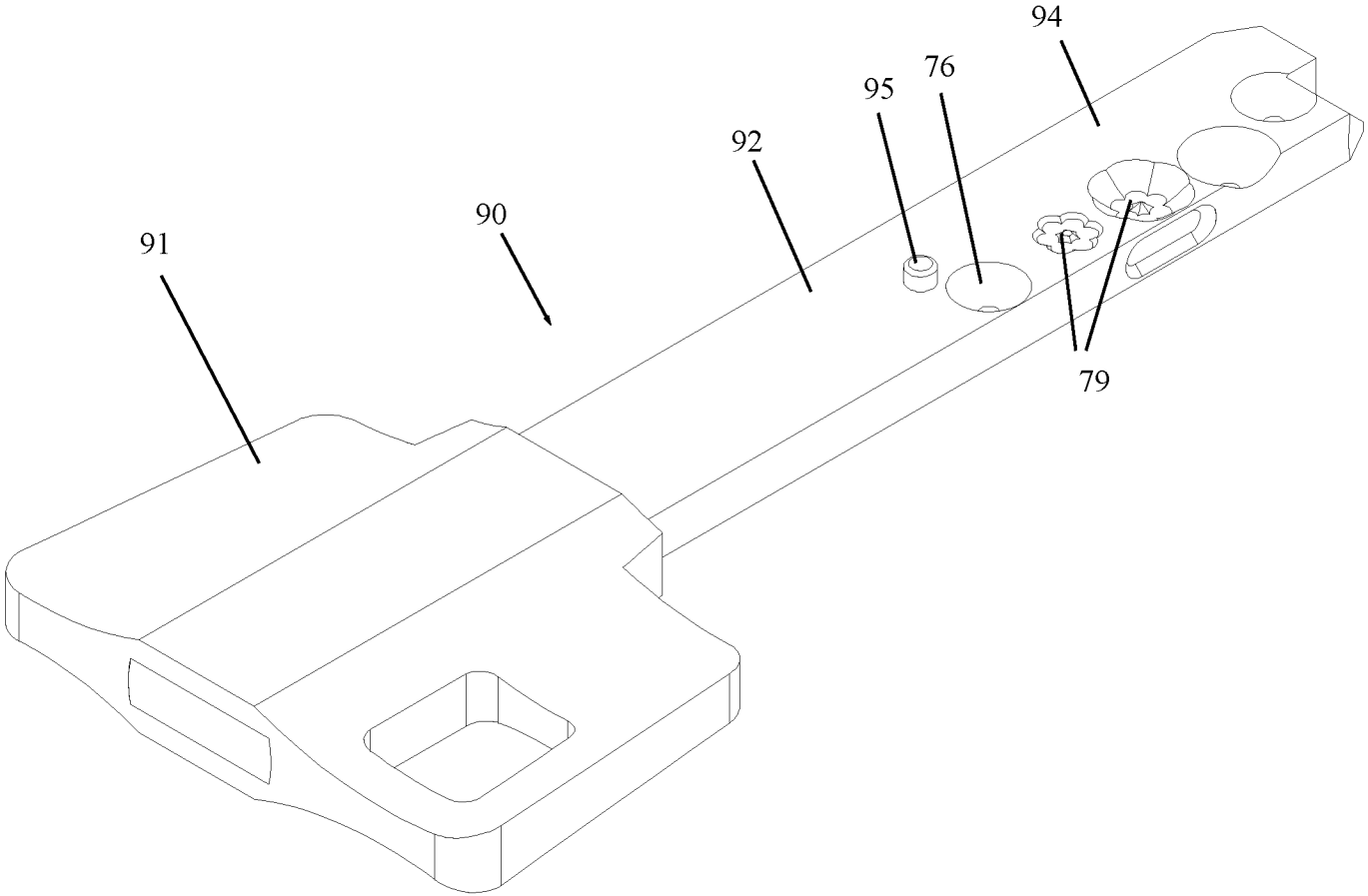
FIG. 3 is a simplified perspective illustration of a key with key cuts formed thereon for actuating the cylinder lock of FIG. 1.

Reference is now made to FIG. 3, which illustrates a key 90 used to operate the cylinder lock of FIG. 1, in accordance with an embodiment of the present invention. Before any key cuts are made, key 90 is also referred to as key blank 90, and the terms key device, key and key blank will be used interchangeably throughout the specification and claims, except for when the key cuts are discussed, at which time it is a key and not a key blank.

Key 90 has a shaft 92 that has a key-cut surface 94 for forming inward key cuts 76 for interfacing with the key cut interface probes 74 described above. A key head 91 is mounted on shaft 92, such as with a set screw 93. (Other mounting methods can be used, of course.) A fixed key pin 95 protrudes outwards from key-cut surface 94. In one embodiment, shaft 92 has two oppositely-facing key-cut surfaces 94, and fixed key pin 95 has two portions that respectively protrude outwards from the key-cut surfaces 94. For example, the two portions may be collinear, i.e., the fixed key pin 95 simply protrudes outwards from both sides of the key 90. Alternatively, fixed key pin 95 can have two portions offset from each other, i.e., offset from a center line of shaft 92. Fixed key pin 95 is preferably, but not necessarily, located between an area designated for forming the key cuts 76 and key head 91.

Key 90 may be a master key. For example, as seen in FIG. 3, master key cuts 79 may be cut into the key 90 that correspond to all possible radial and X-Y positions of key cut interface probes 74. The slave keys would have only one of these possibilities. Thus, one slave key combination would not operate another slave key combination, but the master key would operate all the slave key combinations.

Fixed Key Pin

Reference is now made to FIGS. 4A-4F, which illustrate operation of fixed key pin 95. A movable catch 98 is mounted in plug 50, and has a protrusion 104 (also seen in FIG. 1), which protrudes towards keyway 55. Movable catch 98 is biased by a biasing device 106 (e.g., coil spring), which is sandwiched between an abutment 108 in plug 50 and an inner surface 110 of movable catch 98. Movable catch 98 has a tongue 112 that extends radially outwards and is initially received in a groove 114 formed in the cylindrical wall 32 of cylinder body 12. When key 90 is fully inserted in keyway 55, fixed key pin 95 moves in a groove 77 (FIG. 1) formed in plug 50 and pushes against a sloped surface 104A (seen in FIG. 5A) of protrusion 104, thereby urging tongue 112 of movable catch 98 out of groove 114, thereby permitting rotation of plug 50.

Figure 4F:
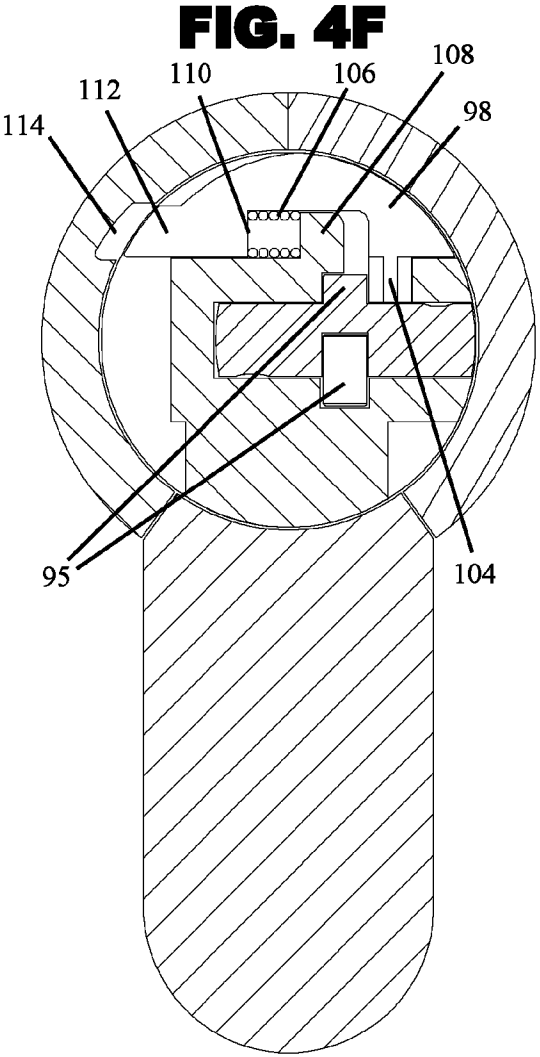

As seen in FIG. 4F, fixed key pin 95 may be made of two parts—one part made of the key blank itself and the other part press fit into a hole in the key blank (both parts made by half-punching or other mechanical process).

Figure 4H:
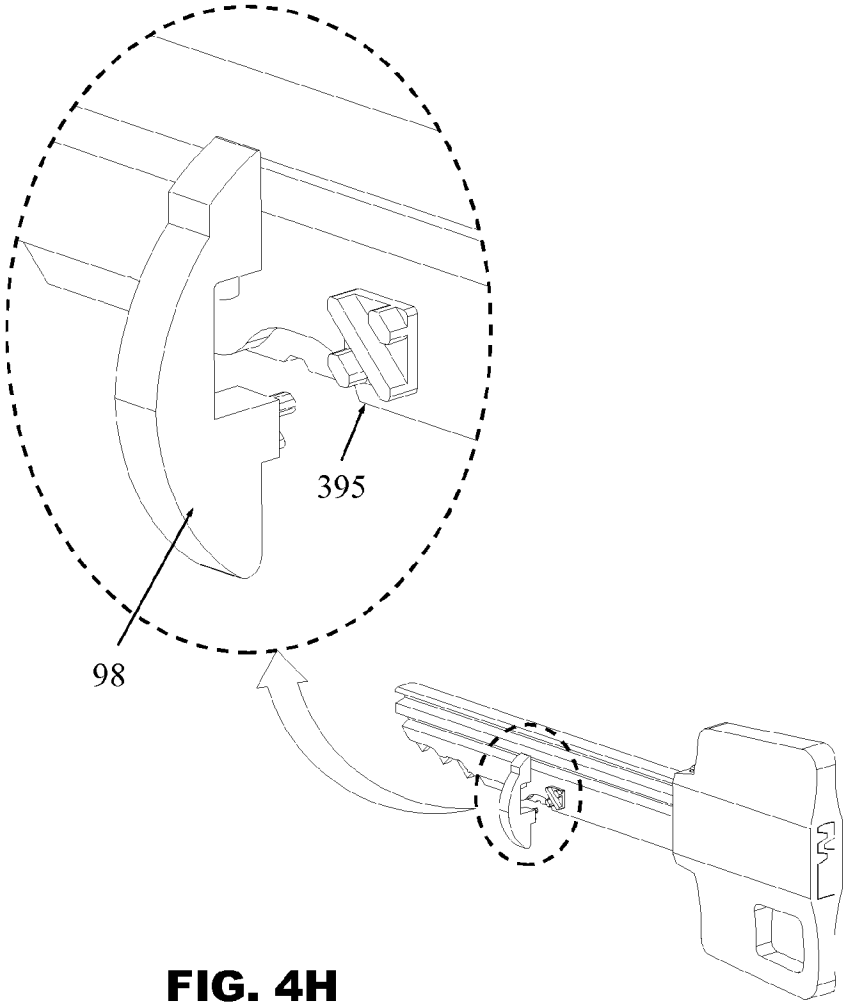
FIGS. 4G and 4H are simplified perspective illustrations of another fixed key pin, in accordance with two other embodiments of the present invention.
Figure 4G:
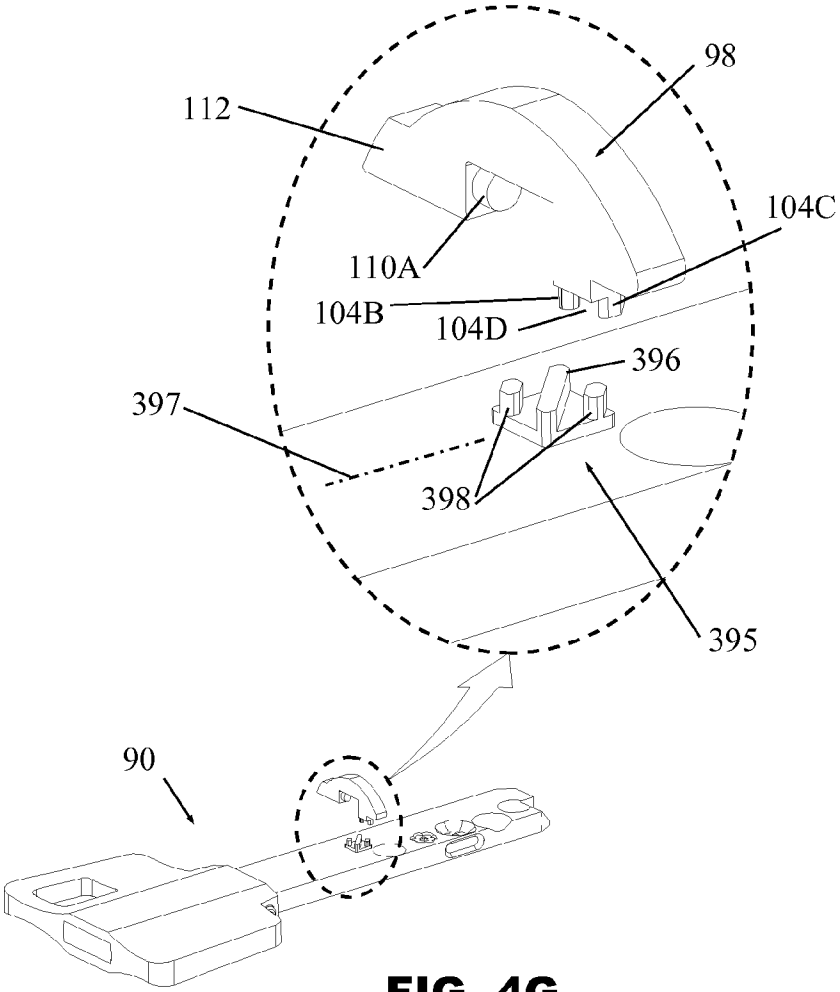

Reference is now made to FIG. 4G, which illustrates another fixed key element 395. As before, movable catch 98 includes tongue 112 and a lug 110A on which biasing device 106 is placed (biasing device 106 being omitted for clarity). In this embodiment, movable catch 98 has two tongues 104B and 104C separated by a gap 104D. Fixed key element 395 includes at least one protrusion, such as a central fixed protrusion 396 arranged at a non-zero angle (for example, without limitation, 45°) with respect to a center line 397 of the key shaft. The central fixed protrusion 396 may be flanked on either side by auxiliary protrusions 398, spaced from, and typically smaller than, central fixed protrusion 396. The auxiliary protrusions 398 may also be arranged at an acute angle (for example, without limitation, 45°) with respect to center line 397; they may be parallel to central fixed protrusion 396. The spacing between the protrusions 396 and 398, their height, length and other dimensions may be selected to suit a particular application for moving the movable catch 98.

When key 90 is fully inserted in keyway 55 (not shown in FIG. 4G), fixed key element 395 moves in a corresponding groove in plug 50 (not shown, but similar to groove 77 of FIG. 1). The central fixed protrusion 396 slides into gap 104D, and pushes against either of tongues 104B and 104C, thereby urging tongue 112 of movable catch 98 out of groove 114 (FIG. 4E), thereby permitting rotation of plug 50. Alternatively, any of the auxiliary protrusions can move tongues 104B or 104C. The protrusions move the tongues in a manner of two toothed racks meshing and moving one another.

FIG. 4H shows an embodiment similar to FIG. 4G, except the key is a standing key (bits formed on the edge, instead of a flat key as in FIG. 4G).

Movable Key Pin

Figure 5B:
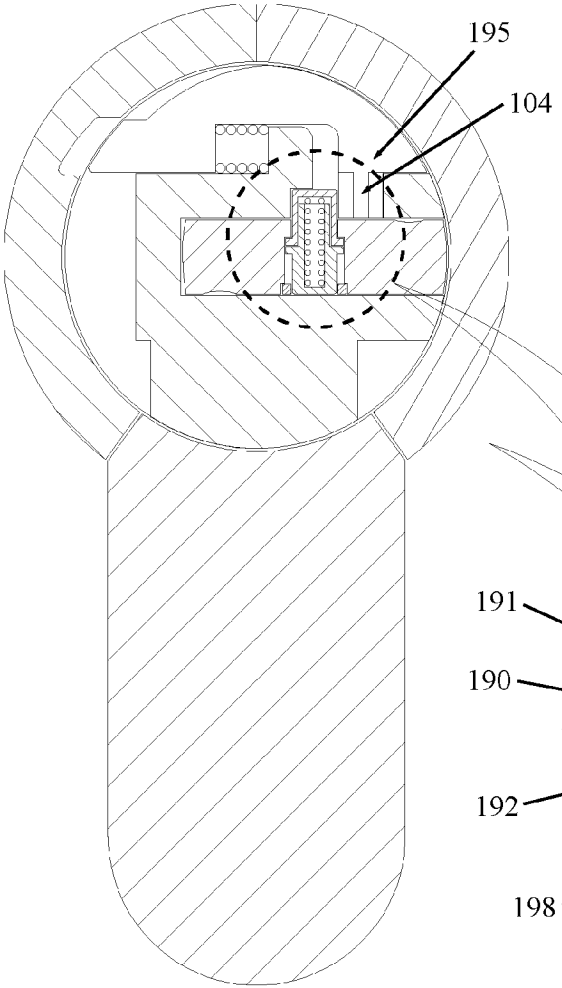
Figure 5A:
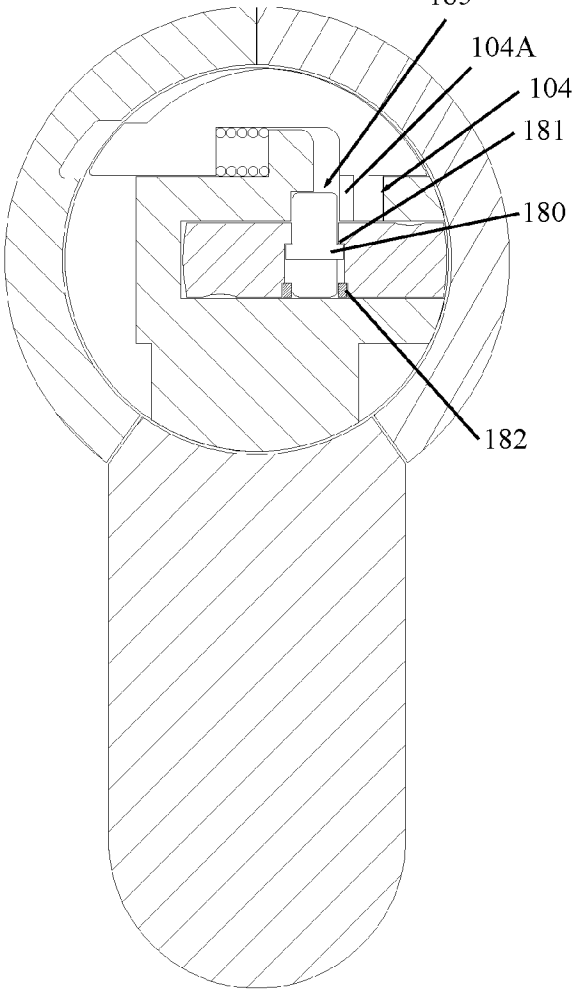

FIG. 5A illustrates another embodiment of the key pin. In this embodiment, the key pin is a movable (floating) key pin 185 which is blocked from going out of the key blank by a flange 180 that in one direction abuts against a stop 181 (e.g., end face of a bore formed in the key blank), and in the opposite direction abuts against a stop 182 (e.g., ring or clip press fit in the key blank). The movable key pin 185 has straight sides (cylindrical) with little or no chamfer. The entrance of the keyway is chamfered so that movable key pin 185 moves inwards during insertion of the key into the keyway. When the key has been fully inserted in the keyway, the movable key pin 185 moves protrusion 104 of movable catch 98 to the side perpendicular to the longitudinal axis of the pin 185, thereby permitting rotation of plug 50 as explained above.

Figure 6:
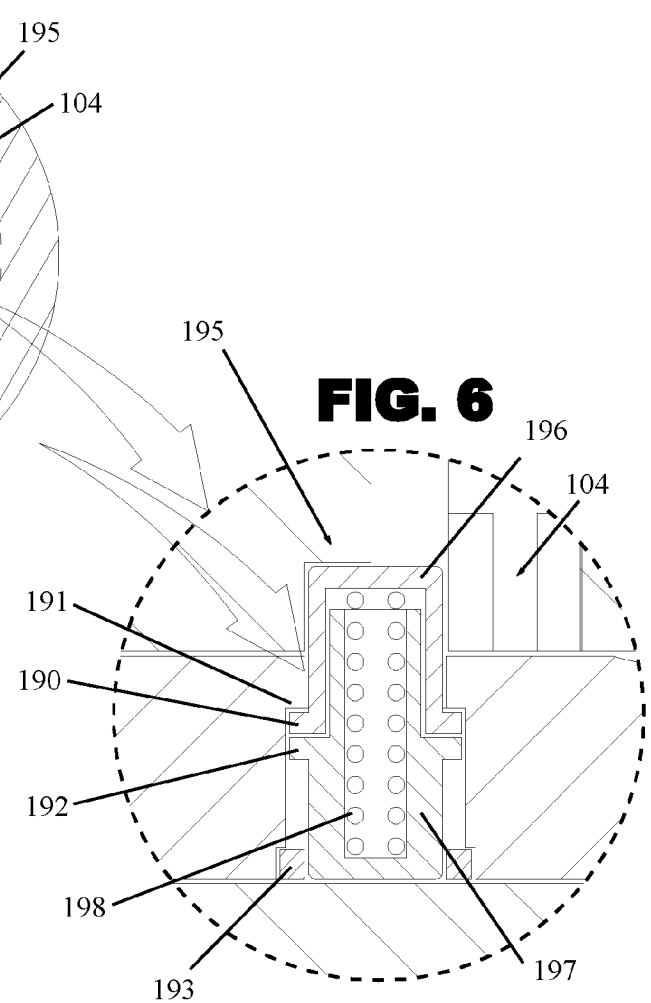
FIGS. 5A, 5B and 6 are simplified sectional illustrations of a movable key pin, constructed and operative in accordance with another embodiment of the invention, wherein the key pin is a movable pin that can protrude out of the key blank upon insertion into the keyway.

FIGS. 5B and 6 illustrate another embodiment of the key pin. In this embodiment, the key pin is a movable key pin 195, constructed of first and second pins 196 and 197 arranged for protruding out of the key blank in opposing directions (typically useful for reversible keys). A biasing device 198, such as but not limited to, a coil spring, is placed between the pins and urges first and second pins 196 and 197 in their outward directions. First pin 196 is blocked from going out of the key blank by a shoulder 190 that abuts against a stop 191 (e.g., end face of a bore formed in the key blank). Similarly, second pin 197 is blocked from going out of the key blank by a shoulder 192 that abuts against a stop 193 (e.g., ring or clip press fit in the key blank). The movable key pin 195 contracts inwards during insertion of the key into the keyway. When the key has been fully inserted in the keyway, the movable key pin 195 moves protrusion 104 of movable catch 98 to the side perpendicular to the longitudinal axis of the pin 195, thereby permitting rotation of plug 50 as explained above.

A different kind of movable key pin is described below with reference to FIGS. 12A-13B.

Increasing Depths for Key Cuts

Figures 7A, 7B, 7C, 7D:
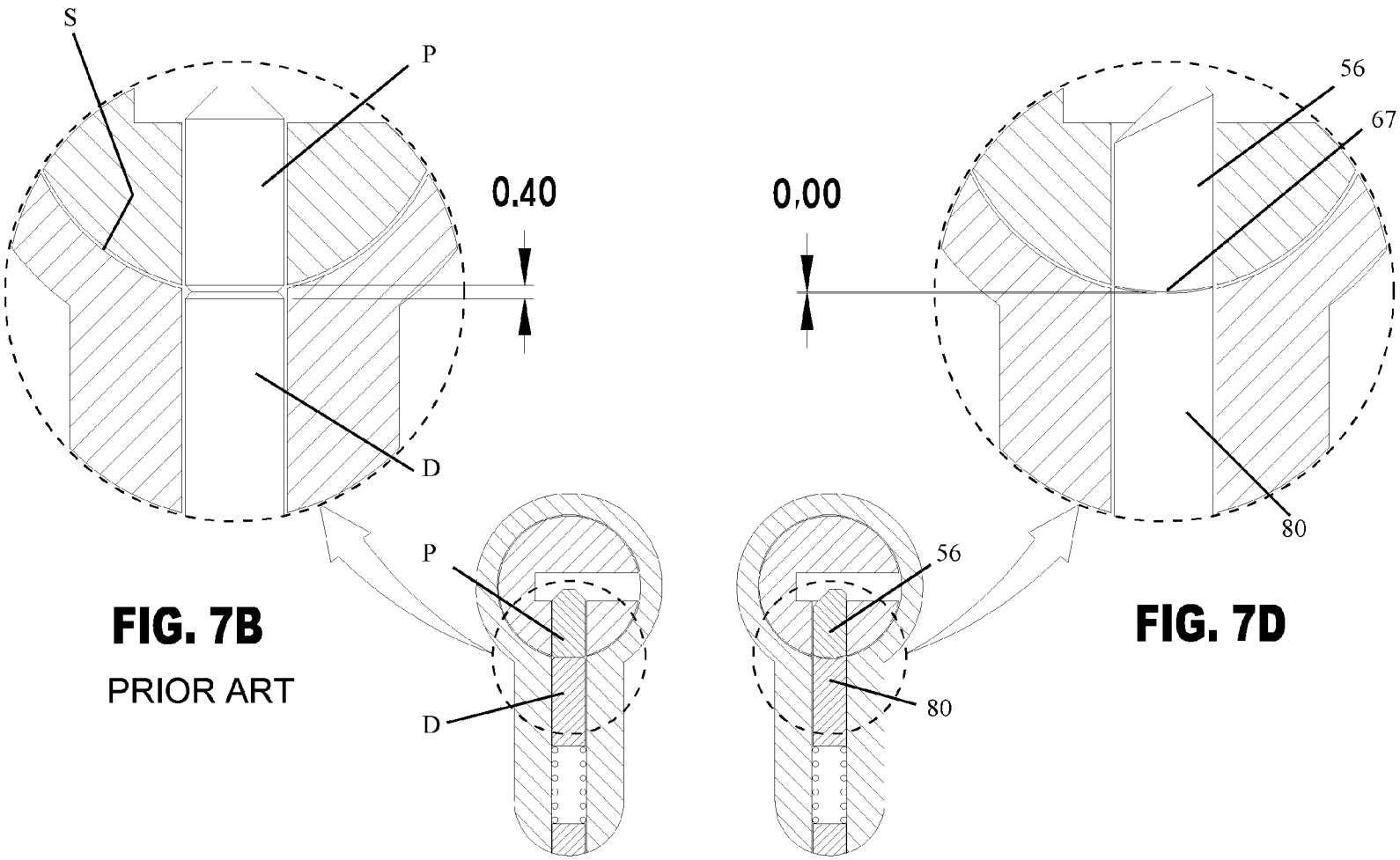
FIG. 7B PRIOR ART
FIG.7A PRIOR ART
FIGS. 7A and 7B are simplified sectional and enlarged sectional illustrations, respectively, of prior art plug pin and driver pin at the shear line.
FIGS. 7C and 7D are simplified sectional and enlarged sectional illustrations, respectively, of the plug pin and driver pin of the cylinder lock of FIG. 1 at the shear line.

Reference is now made to FIGS. 7A and 7B, which illustrate prior art plug pin P and driver pin D at the shear line S. In the prior art, the surfaces of the plug pin P and driver pin D that abut each other are chamfered. This typically means about 0.40 mm of pin depth cannot be used for pin combinations, because this depth has been sacrificed for the sake of chamfering.

Reference is now made FIGS. 7C and 7D, which illustrate the plug locking element 56 and driver pin 80 of the cylinder lock assembly of FIG. 1 at the shear line (same holds true for the cylinder lock assembly of the other embodiments of the invention). The surfaces of plug locking element 56 and driver pin 80 that abut each other are substantially non-chamfered and correspond accurately with the circumferential (circular) shape of the plug because they do not rotate. This means more depth of the locking element can be used for the combination, thereby further increasing the possible number of combinations. This also makes picking and other unauthorized entry attempts more difficult.

Further Embodiments of Cylinder Lock Assemblies

Reference is now made to FIGS. 8, 8A and 8B, which illustrate a cylinder lock 100, constructed and operative in accordance with another embodiment of the present invention. Cylinder lock 100 is similar to cylinder lock 10, with like elements being designated by like numerals. Cylinder lock 100 has a cylinder lock body 12 made of a one-piece construction. In cylinder lock 100, plug locking elements 56 and driver pins 80 are non-rotating and have a cross-section which is droplet-shaped. The biasing device 84 (e.g., coil spring) is placed between the driver pin 80 and a driver base element 99.

It is noted that U.S. Pat. No. 4,098,104 to Wolter, assigned to DOM Sicherheitstechnik GmbH, Brühl, Germany, also has droplet-shaped, non-rotating plug pins. However, unlike the present invention, Wolter uses non-rotating pins merely to enable using two different rows of pins. The equivalent of the "key cut interface probes" on the plug pins of U.S. Pat. No. 4,098,104 (shown in phantom lines as element W in FIG. 8B) is not offset from the centerline of the pin. The pin always interfaces with the driver pins along the centerline. In contrast, in the present invention, the key cut interface probes 74 are offset from the centerline of the plug locking elements, which immensely increases the possible combinations, as mentioned.

Other Embodiments of Cylinder Lock Assemblies

Figures 9, 9A:
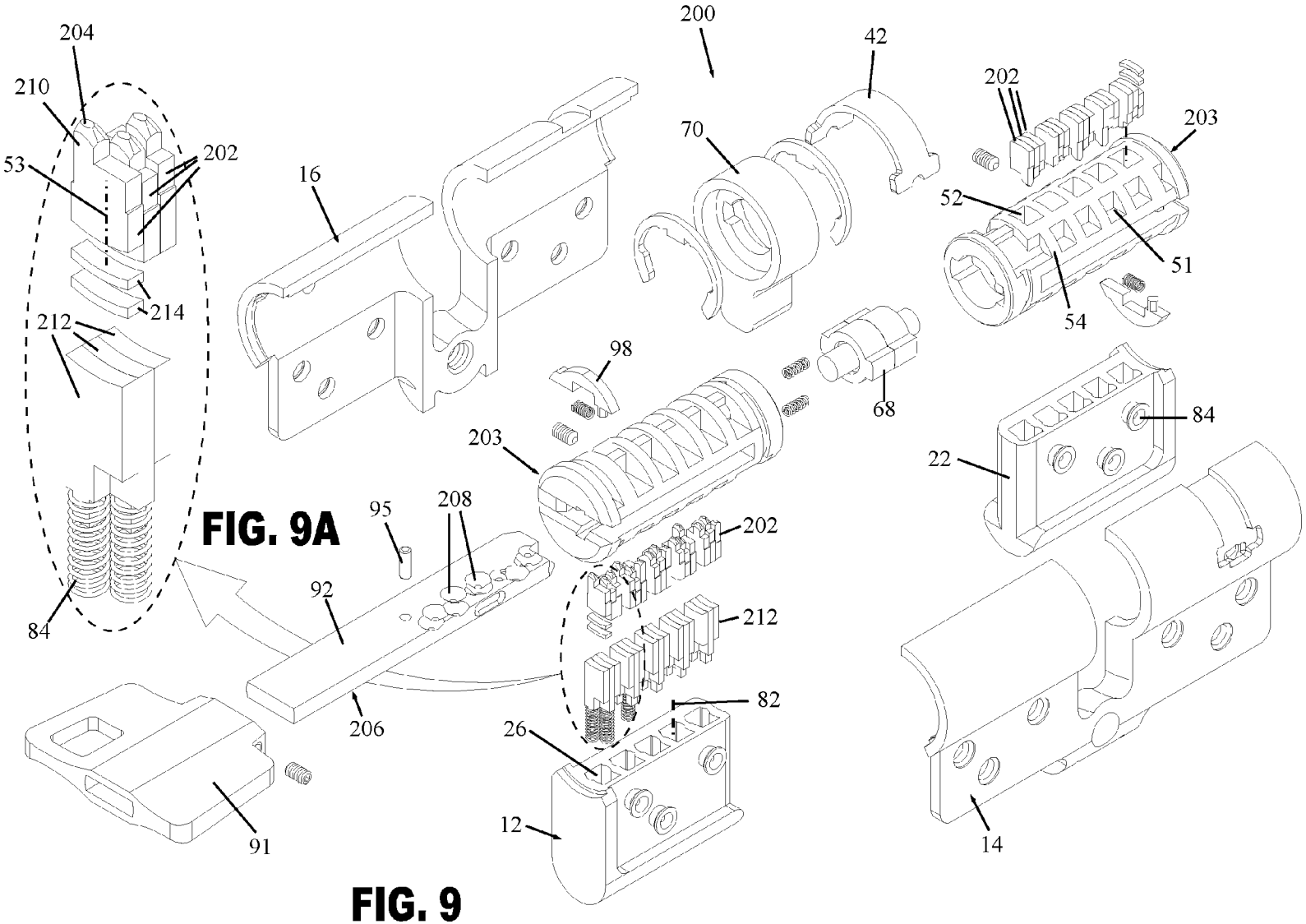
FIG. 9 is a simplified exploded illustration of a cylinder lock, constructed and operative in accordance with an embodiment of the present invention, employing a stack of thin, non-rotating plug locking elements disposed in a plug (the driver pins in the cylinder lock body may also be non-rotating)
FIG. 9A is a simplified enlarged illustration of one stack of the plug locking elements and one stack of driver pins of the cylinder lock body, with a biasing device (e.g., coil spring), plus master key elements as well.

Reference is now made to FIG. 9, which illustrates a cylinder lock assembly 200 (also referred to as cylinder lock 200), constructed and operative in accordance with a non-limiting embodiment of the present invention. The illustrated embodiment is for a European profile double cylinder lock, but it is understood that the invention is not limited to such a cylinder lock. Cylinder lock 200 is similar to cylinder lock 10 or 100, with like elements being designated by like numerals.

Cylinder lock 200 employs a stack of thin, non-rotating plug locking elements 202 disposed in chambers 52 in a plug 203. Plug locking element 202 includes a key cut interface probe 204 for interfacing with a key cut 208 formed on a key 206 (shown in FIG. 11). Each plug locking element 202 is arranged to move along the chamber depth axis 53 and not rotate about the chamber depth axis 53. Each key cut interface probe 204 has a predetermined orientation with respect to the chamber depth axis 53. One or more of the chambers 52 has more than one plug locking element 202 disposed therein; in the illustrated embodiment, all of the chambers 52 have more than one plug locking element 202 disposed therein. As similarly described above, master key cuts 208A may be cut into the key 206 that correspond to all possible positions of key cut interface probes 204.

The use of a stack of thin, planar plug locking elements 202 substantially eliminates the chance of the elements seizing in chambers 52 in plug 203.

The plug locking elements 202 are very thin, for example, without limitation, 1 mm thick. In one example, plug locking element 202 has a thickness at least 3 times less than its width or length. In another example, plug locking element 202 has a thickness at least 2 times less than its width or length. Elements 202 are, of course, made of a suitably strong material, such as but not limited to, cold drawn half hard stainless steel.

Figures 11, 11A:
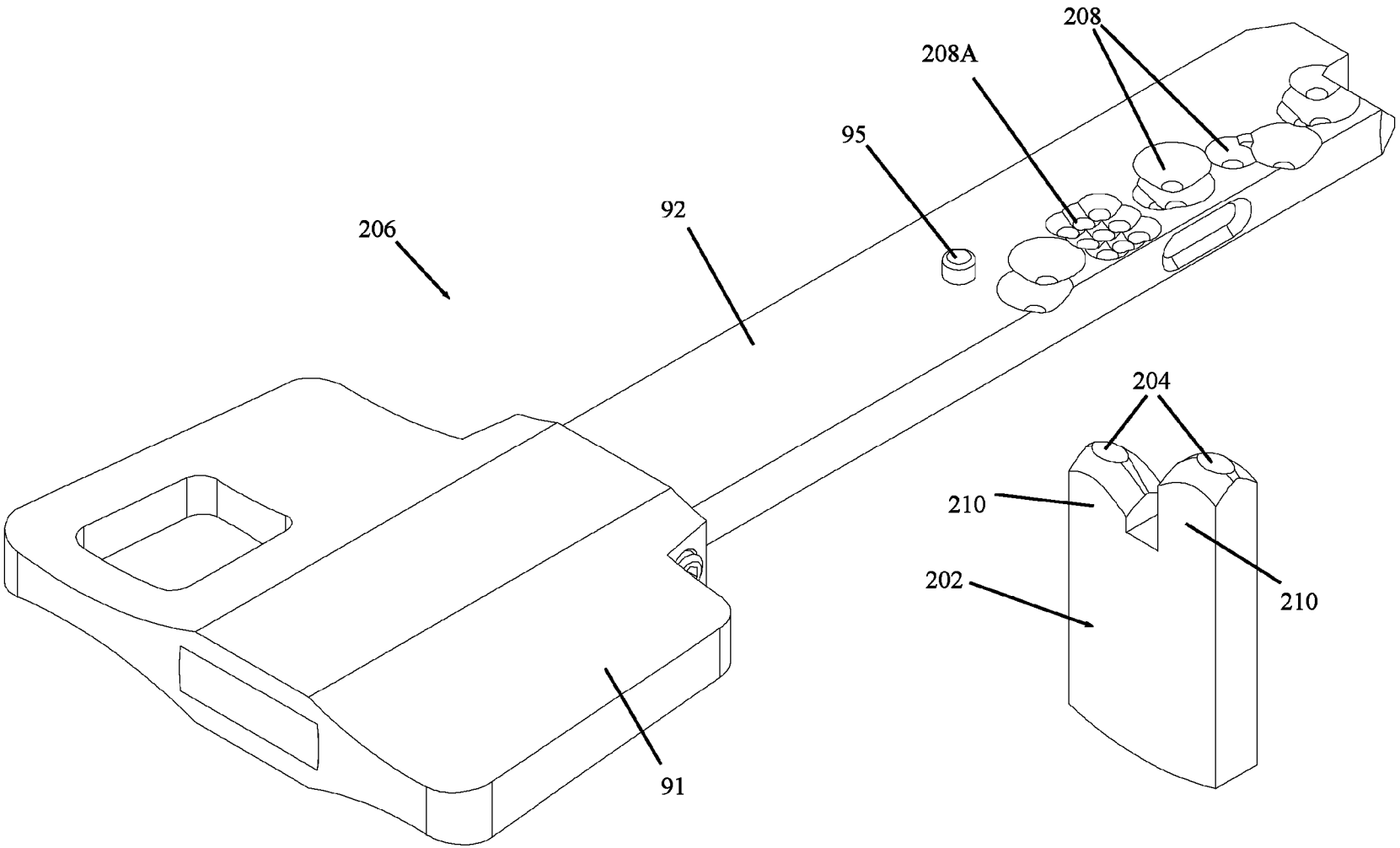
FIG. 11 is a simplified perspective illustration of a key with key cuts formed thereon for actuating the cylinder lock of FIG. 9.
FIG. 11A is a simplified perspective illustration of the possibility of more than one protruding portion, each with its own key cut interface probe, for a single plug locking element of the cylinder lock of FIG. 9.
Figures 12A, 12B:
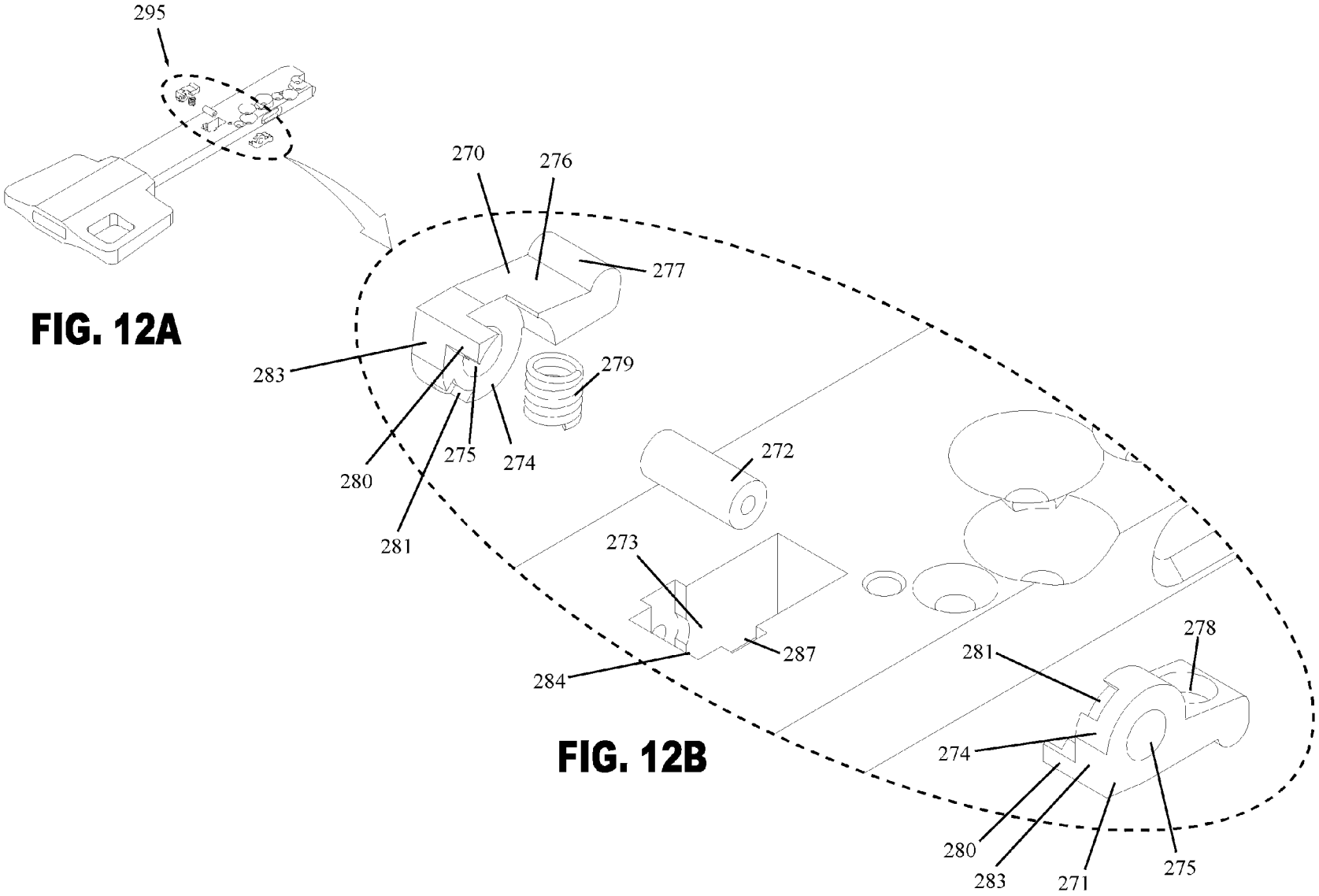
FIGS. 12A and 12B are simplified exploded and enlarged exploded illustrations, respectively, of a movable key pin, constructed and operative in accordance with yet another embodiment of the invention, wherein the key pin includes first and second pivoting pins arranged for protruding out of the key blank in opposing directions.

Plug locking element 202 includes one or more protruding portions 210 on which the key cut interface probe 204 is formed (FIG. 11A illustrates the possibility of more than one protruding portion 210, each with its own key cut interface probe 204, for a single plug locking element 202). FIG. 9A illustrates one stack of the plug locking elements 202 and one stack of corresponding driver pins 212 of the cylinder lock body 12. The driver pins 212 are biased by biasing device 84 (e.g., coil spring). The biasing device 84 may be constructed and mounted directly on the tails of driver pins 212. FIG. 9A also shows the optional addition of master key elements 214.

Figure 10:
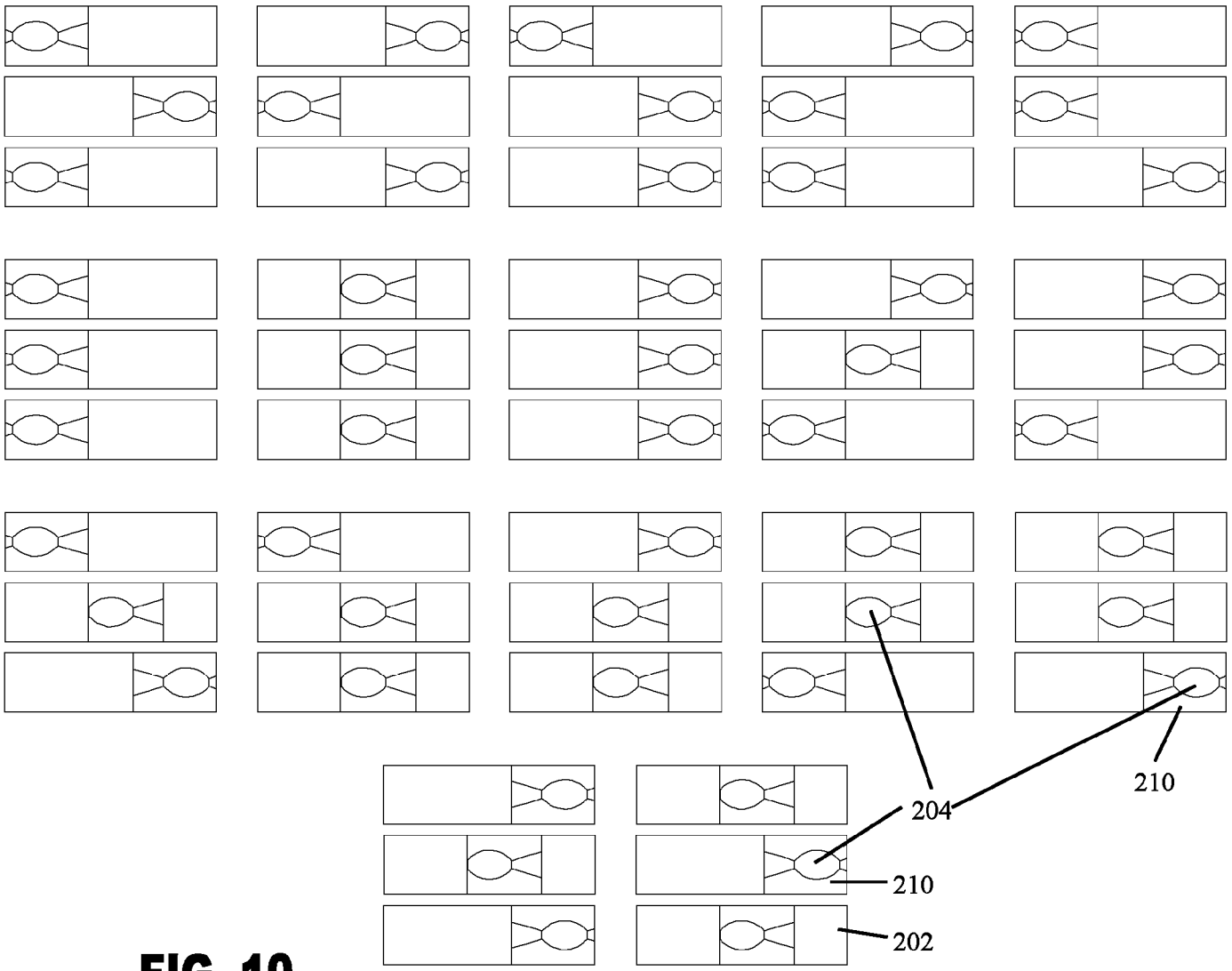
FIG. 10 is a top-view illustration of different possible orientations of key cut interface probes formed on the plug locking elements of FIG. 9, in accordance with an embodiment of the present invention.

FIG. 10 illustrates different possible orientations of key cut interface probes 204 formed on the plug locking elements of FIG. 9. The invention is not limited to these possibilities. In the illustrated example, there are 17 possible combinations for the plug locking elements 56, each having six (6) different lengths, and five (5) chambers 52, making a total of $(17^6)^5=24137569^5$=more than $8.19346\times10^{36}$ different key theoretical combinations. The improvement of the present invention over the prior art is truly enormous.

Another Movable Key Pin

Reference is now made to FIGS. 12A-13B, which illustrate a movable key element 295, constructed and operative in accordance with yet another embodiment of the invention. Key element 295 includes first and second pivoting levers 270 and 271 arranged for protruding out of the key blank in opposing directions (typically useful for reversible keys). First and second pivoting levers 270 and 271 may be made as identical parts (or not, if desired). First and second pivoting levers 270 and 271 are mounted on a common pivot 272, such as a pin or the like, which may be press fit in a transverse groove 287 formed in a groove 273 in the key blank. Transverse groove accurately defines the position of levers 270 and 271.

First and second pivoting levers 270 and 271 each have a hub 274 with a hole 275 through which pivot 272 is received. Extending from hub 274 is an arm 276 with an outwardly facing surface 277. A blind hole 278 is formed in arm 276 on the opposite side of outer surface 277. A biasing device 279, such as but not limited to, a coil spring, is placed between the levers in holes 278, and urges first and second levers 270 and 271 in their outward directions. Hub 274 has an outwardly projecting lug 280 and a groove 281. When the first and second pivoting levers 270 and 271 are assembled together, the lug 280 of one lever is received in the groove 281 of the other lever and vice versa. The lug 280 can move in groove 281 as each lever rotates about its pivot 272 upon urging by biasing device 279, until lug 280 is stopped by the inner wall of groove 281. This defines the limits of the pivoting motion of first and second pivoting levers 270 and 271 about pivot 272. This ensures that the arm 276 of movable key element 295 accurately positions the plug locking elements to the shear line. The lever which does not move the plug locking element touches the side of the keyway opposite to the plug locking elements.

Hub 274 has a flat surface 283 which can abut against inner wall 284 of groove 273, which limits the outward pivoting motion of first and second pivoting levers 270 and 271. This ensures that when the key has not yet been inserted in the keyway, the first and second pivoting levers 270 and 271 are centered with respect to the key shaft such that they abut against the sloped entrance of the keyway and pivot inwards to allow insertion of the key into the keyway.

Figure 13B:
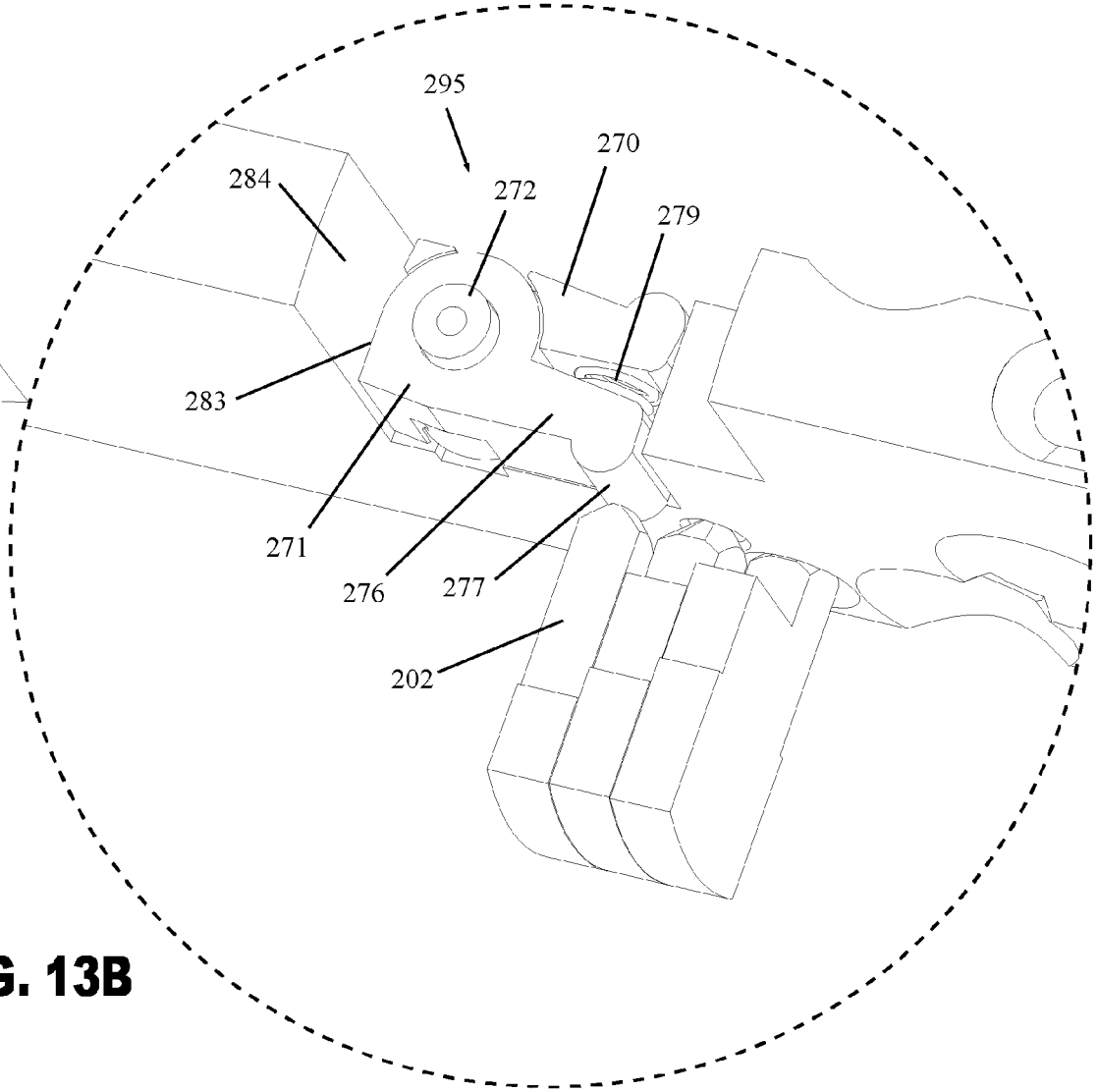
FIGS. 13A and 13B are simplified pictorial and enlarged illustrations, respectively, of the movable key pin of FIGS. 12A and 12B, interacting with plug locking elements of the cylinder lock of FIG. 9.
Figure 13A:
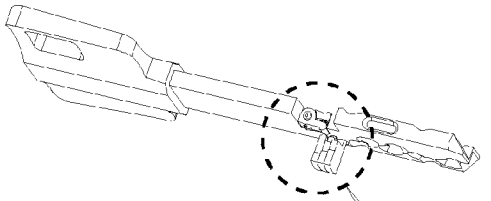

FIGS. 13A and 13B illustrate the outer surface 277 of arm 276 of movable key element 295 interacting with plug locking elements 202 of the cylinder lock of FIG. 9. The movable key element 295 contracts inwards during insertion of the key into the keyway. When the key has been fully inserted in the keyway, one of the first and second levers 270 and 271 moves outwards to push against one of the plug locking elements 202.

What is claimed is:

1. A key device comprising:

a shaft comprising a key-cut surface capable of being cut for forming inward key cuts thereon, said shaft having a relatively wide surface extending from a relatively narrow edge surface;

a key head mounted on said shaft; and a fixed key element protruding outwards from said relatively wide surface of said shaft, wherein said fixed key element comprises a fixed oblong protrusion arranged at an acute angle with respect to a center line of said shaft and wherein said fixed oblong protrusion is flanked on both sides by auxiliary protrusions which have inner sides arranged at an acute angle with respect to the center line of said shaft, said inner sides spaced from and facing towards said fixed oblong protrusion, and wherein said auxiliary protrusions are shorter in length than said fixed oblong protrusion, length being defined along said acute angle.

2. The key device according to claim 1, wherein said shaft has two oppositely-facing relatively wide surfaces, and said fixed key element has two portions that respectively protrude outwards from said relatively wide surfaces.

3. The key device according to claim 2, wherein said two portions are collinear.

4. The key device according to claim 1, wherein said fixed oblong protrusion and said auxiliary protrusions are mounted on a common base affixed to said shaft.

5. The key device according to claim 1, wherein said fixed key element and said key-cut surface are both on said relatively wide surface.

6. The key device according to claim 1, wherein said key-cut surface is on said narrow edge surface.

7. The key device according to claim 1, further comprising key cuts cut inwards into said key-cut surface and wherein said fixed key element protrudes outwards from said key-cut surface.

8. A method comprising:

inserting the key device of claim 1 in a keyway of a cylinder lock and using, said fixed key element to move an element in said cylinder lock to achieve a shear line.

* * * * *